US006619253B2

(12) United States Patent
Kobayashi et al.

(10) Patent No.: US 6,619,253 B2
(45) Date of Patent: Sep. 16, 2003

(54) CASE MEMBER MOUNTING STRUCTURE

(75) Inventors: Toshiki Kobayashi, Wako (JP); Keiko Yoshida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/982,961

(22) Filed: Oct. 22, 2001

(65) Prior Publication Data

US 2002/0046727 A1 Apr. 25, 2002

(30) Foreign Application Priority Data

Oct. 24, 2000 (JP) ..... 2000-324279

(51) Int. Cl.[7] ..... F02F 7/00
(52) U.S. Cl. ..... 123/195 C
(58) Field of Search ..... 123/195 C, 195 R, 123/195 A, 195 S, 195 AC, 195 H, 195 HC, 196 R, 198 R, 198 E; 74/606 R

(56) References Cited

U.S. PATENT DOCUMENTS 6,213,073 B1 * 4/2001 Iwata ..... 123/90.38
6,308,673 B1 * 10/2001 Kobayashi ..... 123/90.38

FOREIGN PATENT DOCUMENTS

JP 7-83069 3/1995

* cited by examiner

*Primary Examiner*—Henry C. Yuen
*Assistant Examiner*—Hyder Ali
(74) *Attorney, Agent, or Firm*—Armstrong, Westerman & Hattori, LLP

(57) ABSTRACT

In a case member mounting structure for mounting a chain case to an engine body, the chain case is fastened to the engine body by a number of bolts applied along the outer edges thereof and by bolts applied to portions in a central region thereof. The chain case has a plurality of central fastening boss portions in a central region of the inner wall surface, and bolt fastening holes are formed in the respective central fastening boss portions. An annular connection wall is formed in a projecting fashion to connect the central fastening boss portions such that the chain case is affixed to the engine body by putting the connection wall and the central fastening boss portions in abutment with the engine body. As a result, it is possible to fasten the chain case with fewer fastening bolts, enhance the rigidity of the central region of the chain case and prevent its vibrations.

20 Claims, 9 Drawing Sheets

CASE MEMBER MOUNTING STRUCTURE

BACKGROUND OF THE INVENTION

1. Field of the Invention

This invention relates to a mounting structure for mounting a case member to a functional machinery body such as an engine.

2. Description of the Related Art

An overhead cam-type engine, for example, includes a timing chain disposed on a lateral portion of the engine body for transmitting the engine power to the valve system, and the timing chain is covered by a chain case as a case member. The chain case is affixed to the engine body with its circumferential portion, and accommodates the timing chain in its inner cavity.

For example, Japanese Patent Laid-Open Publication No. hei 7-83069 discloses a chain case of a V-type engine. As shown in FIG. 9, the chain case 01 of the V-type engine is disposed on a lateral portion of an engine body like a cylinder block or a cylinder head. The chain case 01 has boltholes 02 substantially equally space along the circumferential portion, and it is affixed to the engine body by means of these boltholes 02. The chain case 01 also has a plurality of fastening boss portions 03 at predetermined positions in a central region, and boltholes 04 are formed through these fastening boss portions 03.

In this manner, the chain case 01 is fastened with bolts to the engine body at the plurality of fastening boss portions 03 in the central region not only along its circumferential portion such that the central region is integrally affixed to improve the rigidity. However, since the central region of the chain case 01 is fastened to the engine only locally at the fastening boss portions 03, rigidity of the entire central region cannot be enhanced unless a lot of such fastening boss portions 03 are formed to fix the central region of the chain case 01 to the engine body at many positions. The use of such a lot of fastening boss portions invites a complicated shape of the chain case and the need of a corresponding large number of fastening means such as bolts, which makes mounting of the chain case annoying.

It is therefore an object of the invention to provide a case member mounting structure that can improve the rigidity of a central region of a case member and can thereby minimize vibrations while facilitating its mounting with fewer fastening means.

SUMMARY OF THE INVENTION

To accomplish the above-mentioned object, according to the invention, there is provided a case member mounting structure for mounting a case member to a machinery body, comprising:

outer edge fastening means for fastening an outer edge region of the case member to the machinery body; and center fastening means for fastening a central region of the case member to the machinery body, the center fastening means including: a plurality of central fastener elements formed on an inner surface of the case member; and a raised connection wall connecting the central fastener elements, the case member being mounted to the machinery body by putting the connection wall and the central fastener elements in abutment with the machinery body.

In this manner, since the connection wall projecting from the inner wall surface of the case member to connect the central fastener elements, together with these central fastener elements, get in abutment with the machinery body, the case member is enhanced in rigidity by the fixture of its central region to the machinery body, thereby to prevent vibrations of the central region and noise thereof.

The structure using the abutment of the connection wall connecting the central fastener element with the machinery body contributes to simplifying the shape of the case member without the need of using a number of central fastening portions. It results in the need of fewer fastening means and making the assembly easier. Further, the connection wall also enhances the rigidity of the fastening portions and additionally enhances the fastening rigidity of the case member.

The connection wall is preferably annular. A through hole may be formed in the region inside the annular connection wall and may be used as means for mounting another member to the machinery body.

Because the case member is affixed by putting the annular connection wall in the central region of the case member in abutment with the machinery body, the structure is enhanced in rigidity, and vibrations of the central region can be prevented effectively.

The through hole made in the region inside the annular connection wall of the case member contributes to reducing the weight. At the same time, since the through hole can be used to mount the other member to the machinery body, it contributes to efficient use of the space. The other member can be detachably mounted in the machinery body without the need of removing the case member.

According to the invention, there is further provided a case member mounting structure for mounting a chain case to an engine body, comprising: outer edge fastening means for fastening an outer edge region of the chain case to the engine body; and center fastening means for fastening a central region of the chain case to the engine body, the center fastening means including: a plurality of central fastener elements formed on an inner surface of the chain case; and a raised connection wall connecting the central fastener elements, the case member being mounted to the machinery body by putting the connection wall and the central fastener elements in abutment with the machinery body.

DESCRIPTION OF THE PREFERRED EMBODIMENT

An embodiment of the invention will now be explained below with reference to the drawings. This embodiment is application of the invention to an engine. The engine 1 is a serial four-cylinder four-stroke cycle engine of a DOHC (double overhead camshaft) type, which is to be mounted in a motor vehicle in a transverse posture (orienting the crankshaft to extend in the right-and-left direction).

Figure 1:
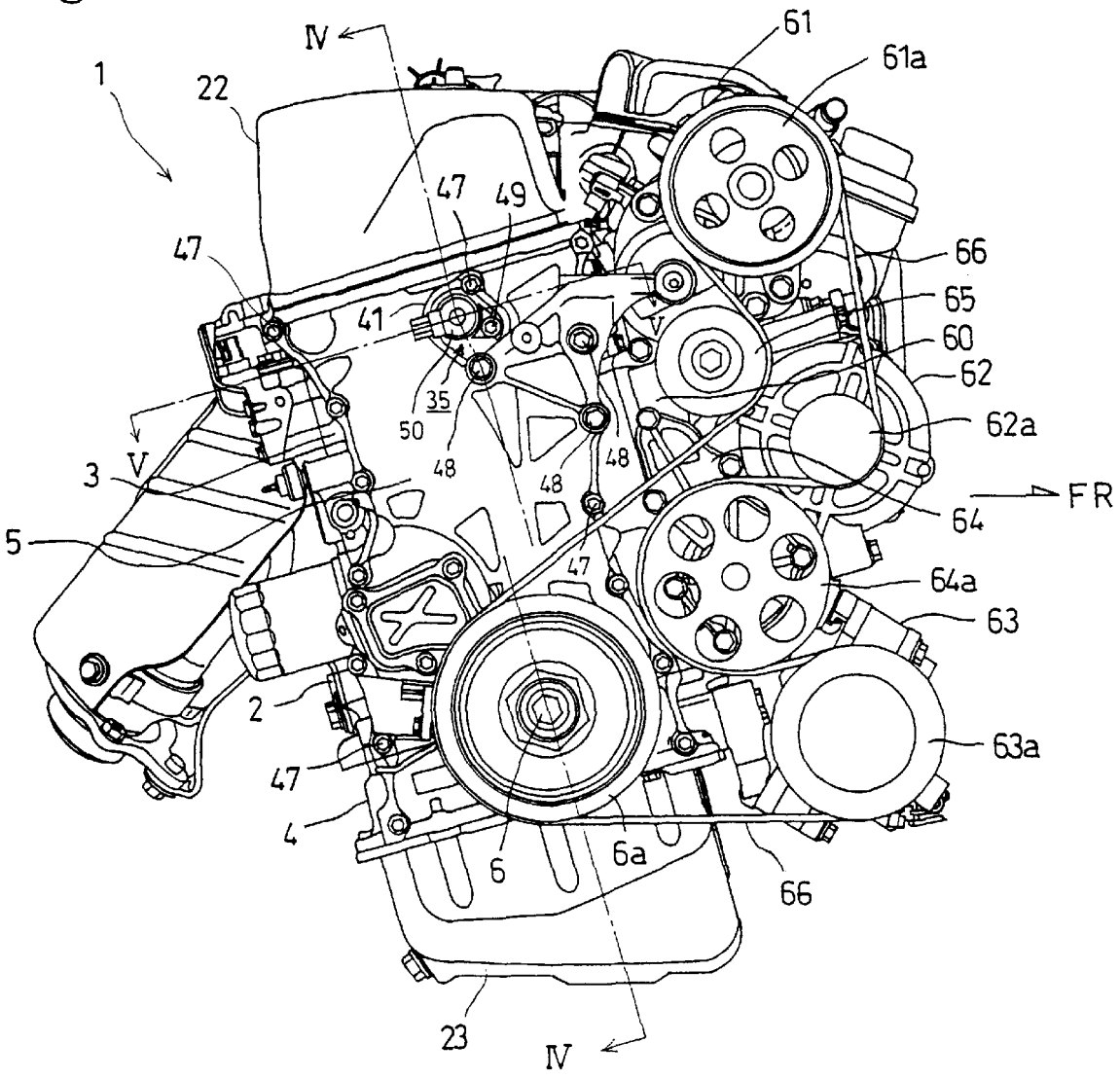
FIG. 1 is a side elevational view of the entirety of an engine having an embodiment of the case mounting structure according to the invention.

In FIG. 1, the main body of the engine 1 includes a cylinder block 2, a cylinder head 3 disposed above the cylinder block 2, and a crankcase 4 disposed below the cylinder block 2. The cylinder block 2, cylinder head 3 and crankcase 4 are joined together with nuts engaging bolts or stud bolts, not shown. A chain case 5, which is a case member of the engine, is removably fixed, as explained later, on the right lateral surface of the cylinder block 2, cylinder head 3 and crankcase 4 in terms of the right-and-left direction of a motor vehicle (which appears as the plane parallel to and nearer to the viewer side of the sheet of FIG. 3, which shows an aspect after removing the chain case from the aspect of FIG. 1).

In FIG. 1, in the right-hand region of the engine 1, auxiliary machines, i.e. hydraulic pump 61, AC generator 62, compressor 63, and water pump 64, are mounted via an auxiliary machinery bracket 60, and an endless belt 66 encircles a plurality of pulleys, namely, driven pulley 62*a* fitted on a crankshaft 6, idler pulley 65, driven pulley 64*a* of the hydraulic pump 61, driven pulley 62*a* of the AC generator 62, driven pulley 64*a* of the water pump 64, to drive them simultaneously.

Figure 3:
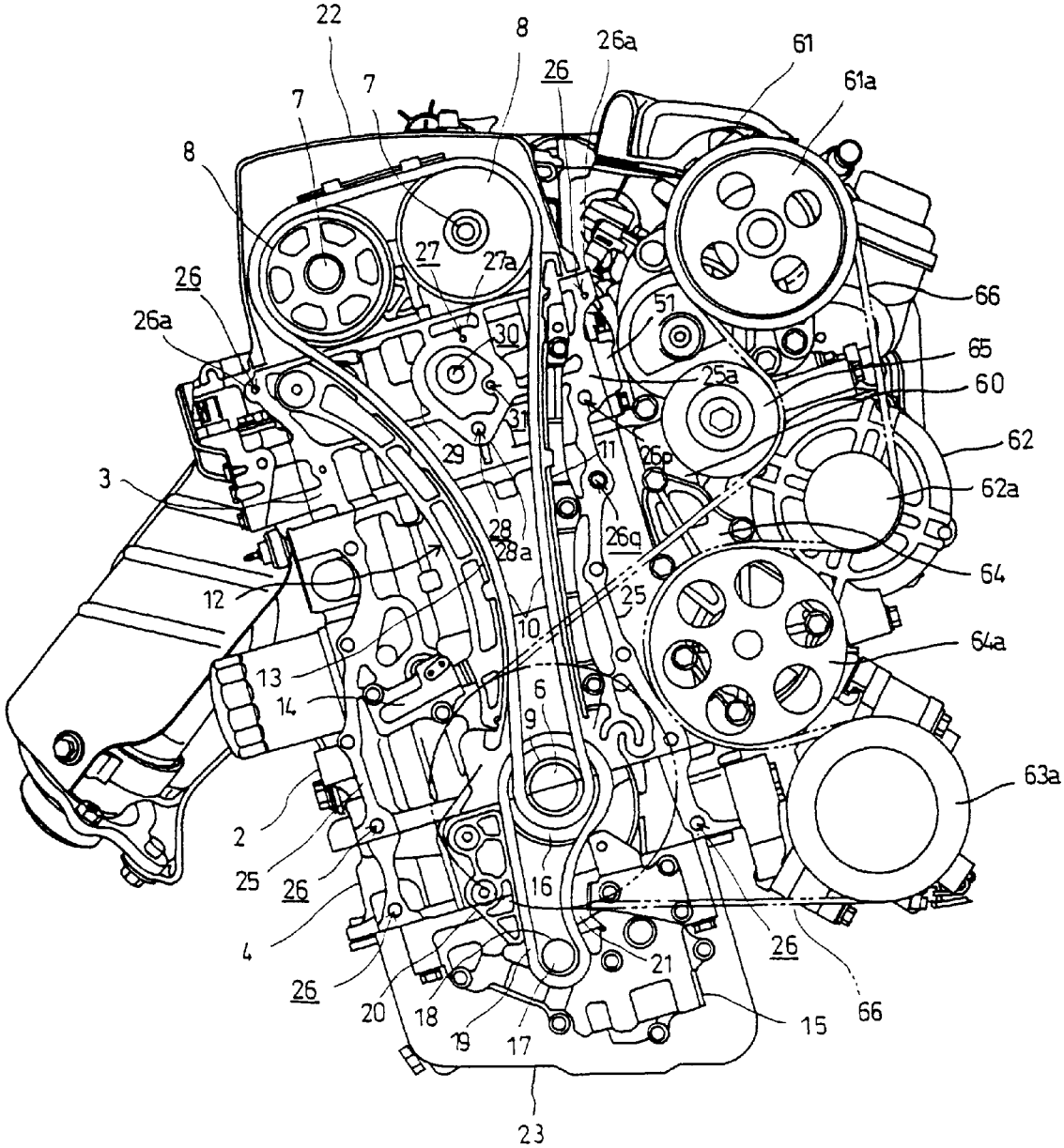
FIG. 3 is a side elevational view of the engine, with a chain case being removed from the configuration of FIG. 2.

As shown in FIG. 3, the crankshaft 6 is rotatably supported at a portion along mating surfaces of the cylinder block 2 and the crankcase 4 of the engine body, and pistons, not shown, are slidably fitted in cylinders, not shown, formed in the cylinder head 3. The pistons and the crankshaft 6 are connected via connecting rods, not shown, such that the crankshaft 6 is rotated when the pistons are reciprocally driven by combustion gas generated in combustion chambers of the cylinders.

The cylinder head 3 has formed a suction port and an exhaust port, neither shown, which communicate with tops of cylinders of the cylinder block 2. The cylinder head 3 also includes a suction valve and an exhaust valve (neither shown) for opening or shutting the suction port and the exhaust port. A suction camshaft 7 and an exhaust camshaft 7 are integrally fitted into the suction cam and the exhaust cam, respectively, to open or shut the suction valve and the exhaust valve, and pivotally supported by the cylinder head 3. Cam chain driven sprockets 8 are individually fitted on the suction camshaft 7 and the exhaust camshaft 7, and an endless cam chain 10 encircles a cam chain drive sprocket 9 integral with the crankshaft 6 and those cam chain driven sprockets 8. A chain guide 11 is provided on one side of the cam chain 10 (right in FIG. 3) whereas a chain tensioner 12 is provided on the other side of the cam chain 10. The chain tensioner 12 includes a chain guide member 13 having a top end pivotally supported by the cylinder head 3, and a lifter 14 attached to the cylinder block 2 to urge a lower portion of the chain guide member 13 toward the cam chain 10 and to apply a tensile force to the cam chain 10. Thus the cam chain 10 is held tensile without loosening such that the suction camshaft 7 and the exhaust camshaft 7 make one revolution in response to two revolutions of the crankshaft 6.

A lubricant oil pump 15 is integrally attached to the bottom surface of the cylinder block 2. An endless chain 19 encircles a pump drive sprocket 16 integral with the crankshaft 6 and a pump driven sprocket 18 integral with the lubricant oil pump 15 and a pump rotating shaft 17. A chain guide 20 is provided on one side (left in FIG. 3) of the chain 19 whereas a chain tensioner 21 is provided on the other side of the chain 19. Thus the chain 19 is held tensile under the resilient restoring force of the chain tensioner 21 itself.

The top portion of the cylinder block 2 is covered and sealed by a cylinder head cover 22, and the bottom of the cylinder block 2 is covered by an oil pan 23 that collects and stores lubricant oil inside the engine 1.

Figure 6:
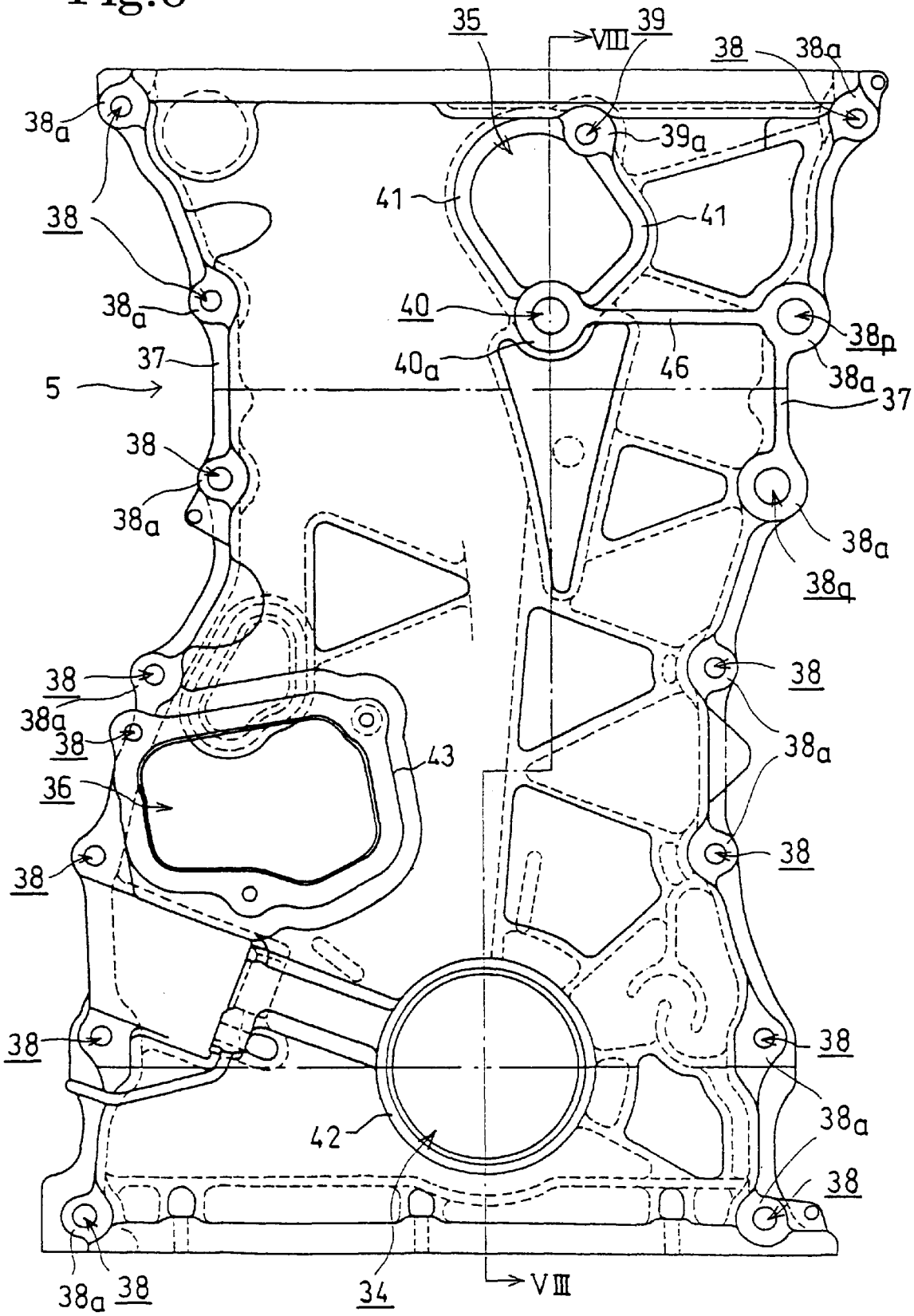
FIG. 6 is a view that shows the front surface of the chain case.
Figure 7:
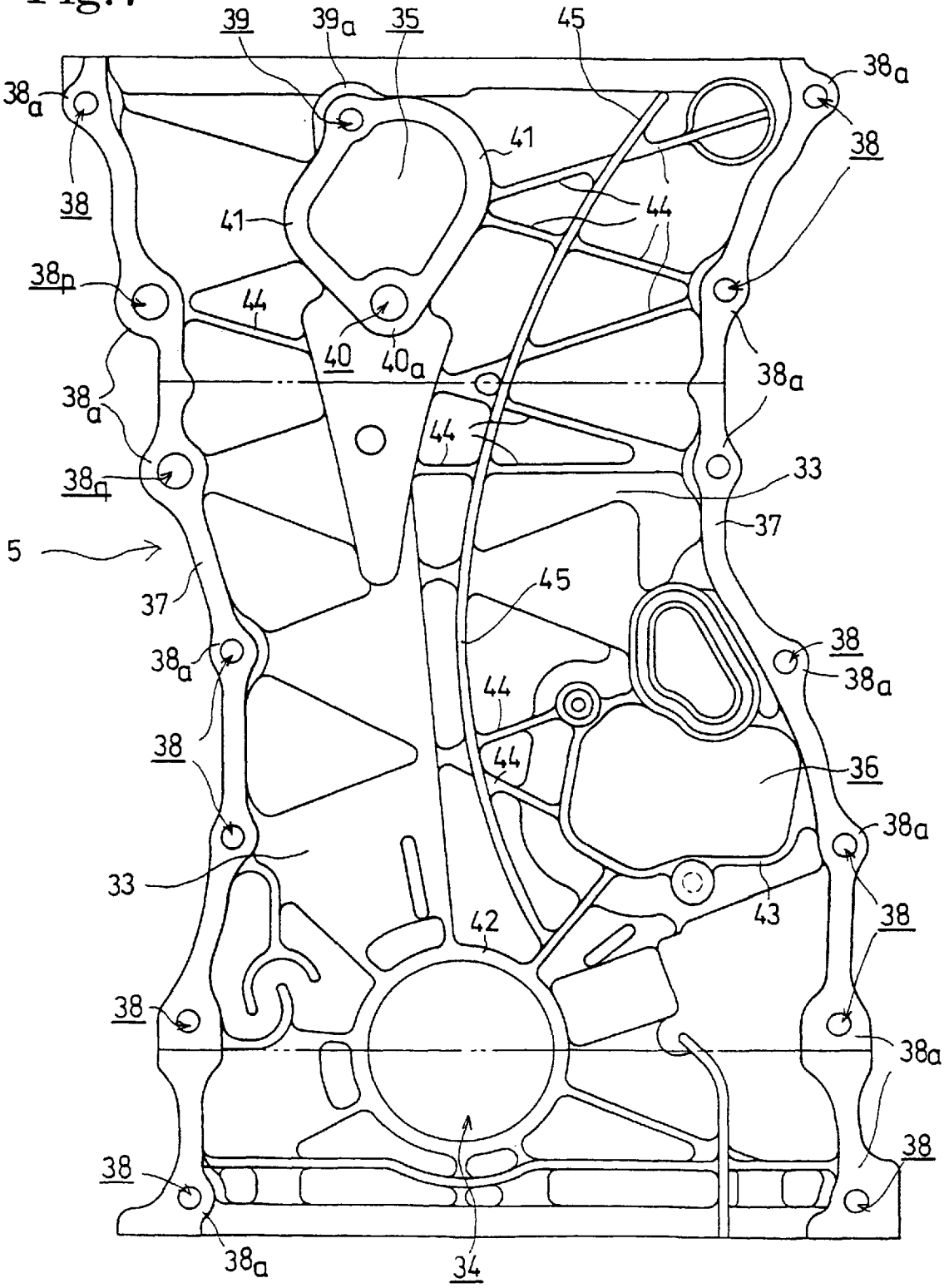
FIG. 7 is a view that shows the back surface of the chain case.
Figure 8:
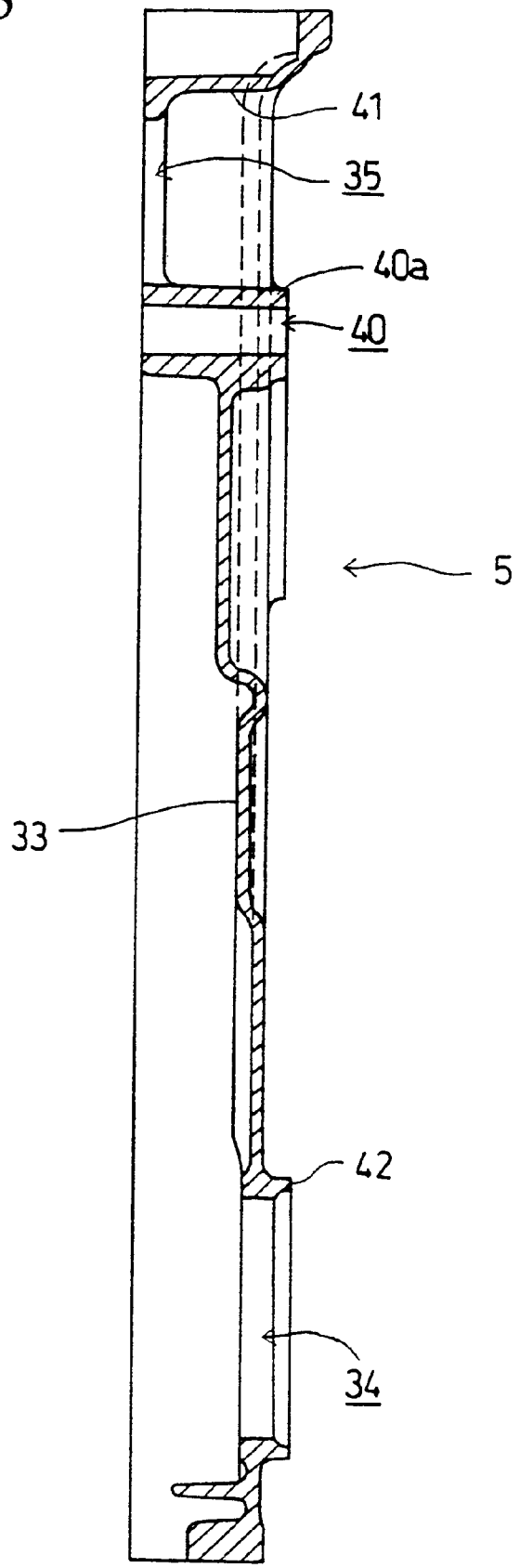
FIG. 8 is a cross-sectional view taken along the VIII—VIII line of FIG. 6.
Figure 9:
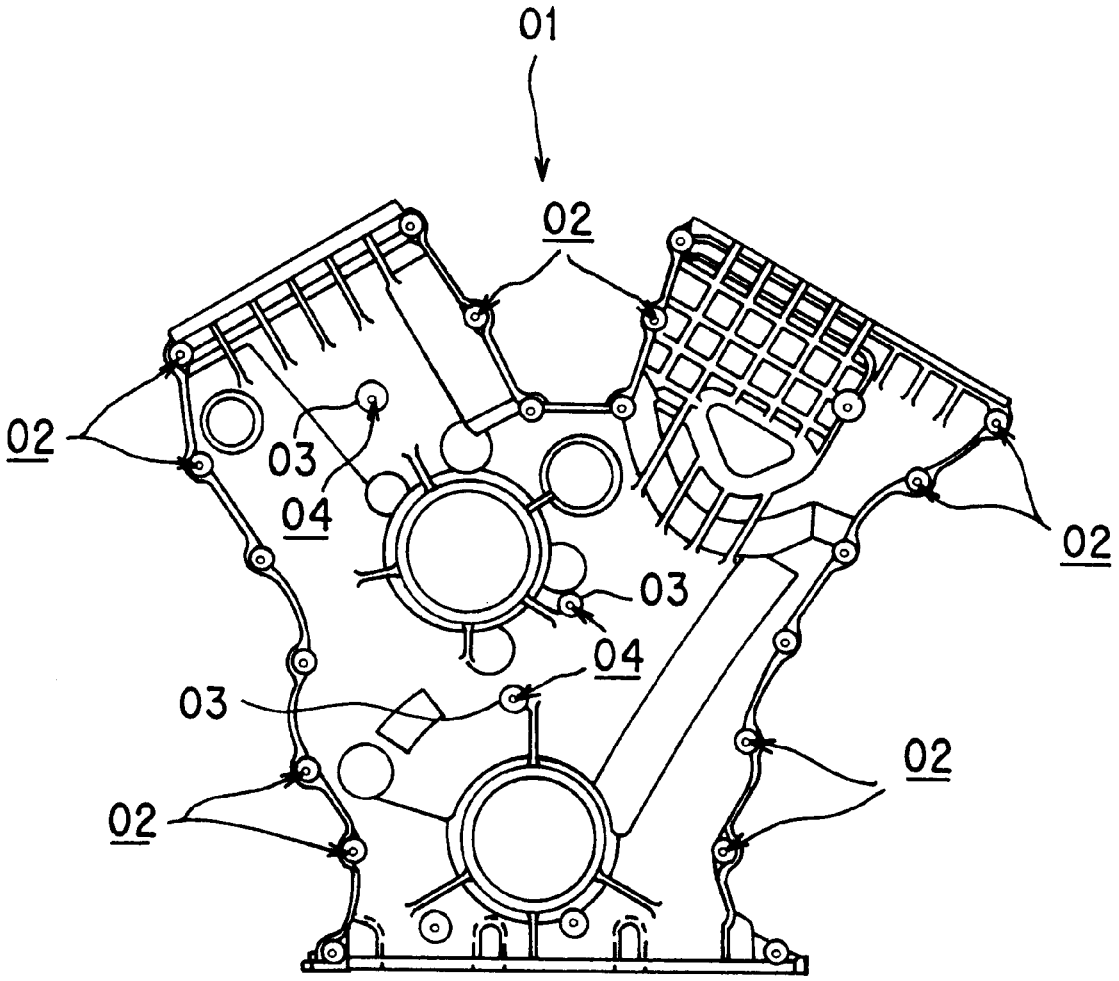
Fig.9 PRIOR ART
FIG. 9 is a view that shows the front surface of a conventional case member.

As shown in FIG. 3, the above-mentioned chain case 5 is provided to seal one end surface of the main body of the engine 1 made up of the cylinder block 2, cylinder head 3 and crankcase 4. The chain case 5 defines an opening 34 at a lower position to permit the crankshaft 6 to pass through as shown in FIGS. 6 through 8. The chain case 5 also defines an opening 35 at an upper position to permit access to a variable valve timing solenoid 50 of the valve system for maintenance and replacement thereof, and a maintenance opening 36 at a position to be aligned with the lifter 14 of the chain tensioner 12.

As shown in FIG. 3, at front and rear borders of the lateral surface of the cylinder block 2, cylinder head 3 and crankcase 4 to be covered with the chain case 5, raised edge walls 25 are formed to project substantially along the contour of the chain case 5, and end surfaces of the edge walls 25 form mating surfaces with the chain case 5 on the same plane. These edge walls 25 have formed boss portions 26*a* having boltholes 26 spaced substantially equally.

Figure 5:
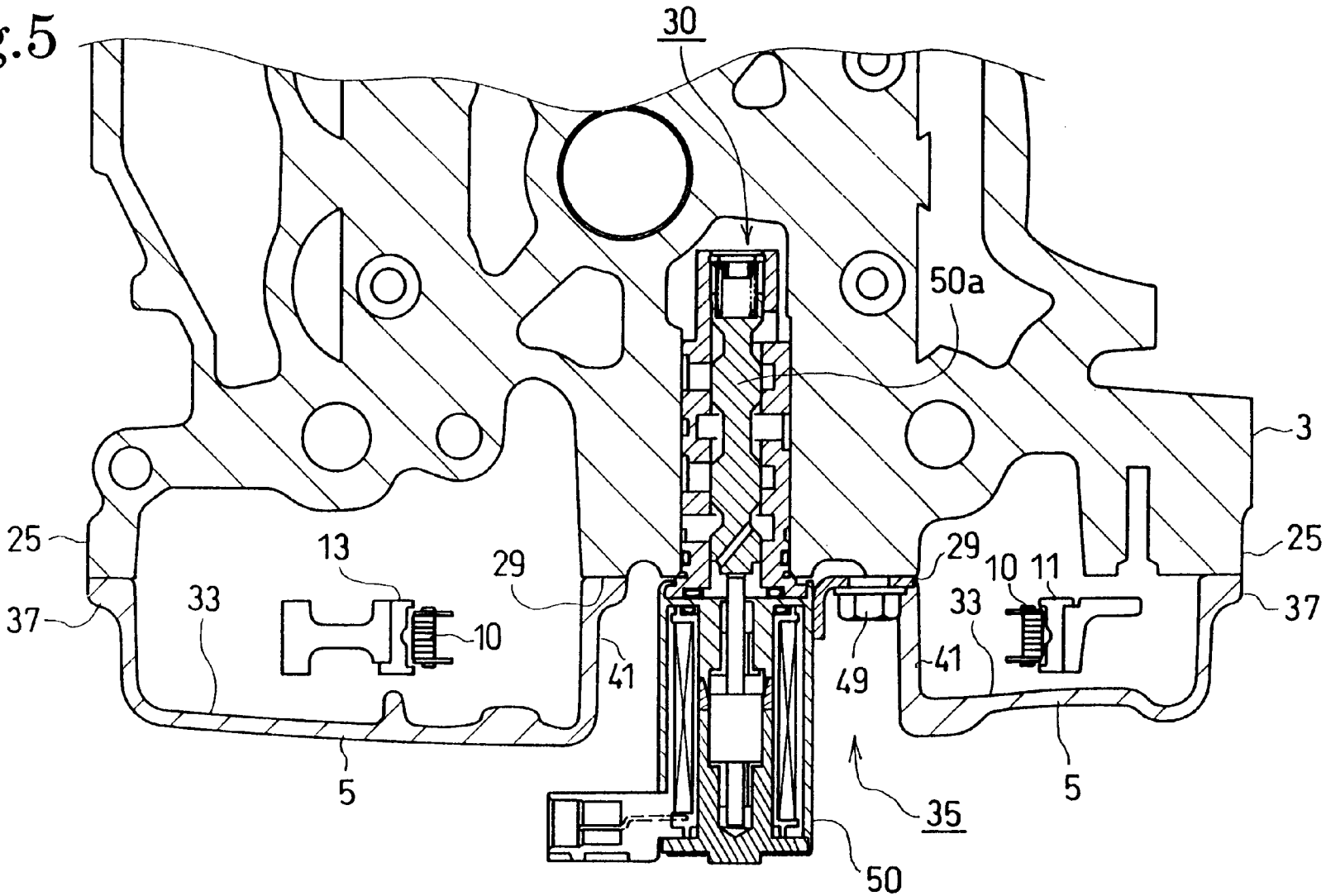
FIG. 5 is a cross-sectional view taken along the V—V line of FIG. 1.

Still as shown in FIG. 3, at a central position of the lateral surface thereof to be covered with the chain case 5, the cylinder head 3 has boss portions 27*a*, 28*a* having boltholes 27, 28 above and below of its region to be aligned with the opening 35 of the chain case 5, and a raised annular projection 29 connects the upper and lower boss portions 27*a*, 28*a*. As shown in FIG. 5, end surfaces of the boss portions 27*a*, 28*a* and the annular projection 29 lie on the same plane as the end surface of the edge walls 25.

In the region encircled by the annular projection 29, an engaging hole 30 (see FIG. 3) for a linear valve of the variable valve timing solenoid 50 to be fit in, and a part of the projection 29 is thickened inward. A bolthole 31 is formed through the inwardly thickened portion. A bolthole 26*p* is formed in front (right in FIG. 3) of the bolthole 28 at the bottom end of the projection 29. The bolthole 26*p* is used as a mount portion 25*a* of an oil-filter 51 (filter of hydraulic oil for variable valve timing) that projects forward of the front wall of the cylinder head 3.

The structure with the chain case 5 and an engine mount bracket 52 (FIG. 4) fastened to the mount portion 25*a* of the oil filter 51 improves the fastening rigidity of the chain case 5 and the engine mount bracket 52.

On the other hand, the chain case 5 has formed front and rear edges 37, as shown in FIGS. 6 through 8, which correspond to front and rear edge walls 25 the engine body. Boss portions 38*a* are formed at positions of the front and rear edges 37 in substantially equal intervals for alignment with the boss portions 26*a* with boltholes 26 of the engine body. These boss portions 38*a* have formed mount holes 38.

As shown in FIG. 6, the chain case 5 has formed boss portions 39*a*, 40*a* having mount holes 39, 40 above and below the opening 35 in an upper central region of the chain case 5. A connection wall 41 connecting the upper and lower boss portions 39*a*, 40*a* is formed to project toward the inner wall surface 33 around the opening 35.

End surfaces of the boss portions 39*a*, 40*a* and the annular connection wall 41 are associated with the front and rear boss portions 27*a*, 28*a* and the annular projection 29 of the engine body, and they are brought into abutment as mating surfaces as shown in FIG. 5.

As shown in FIG. 7, the chain case also has formed circumferential walls 42, 43 along circumferential edges of the openings 34, 36. A plurality of inner ribs 44 are formed on the inner wall surface 33 to connect the boss portions 38*a*, connection wall 41, and circumferential walls 42, 43. Further formed is a curved rib 45 extending along the chain guide member 13 of the chain tensioner 12.

Referring to FIG. 6, an outer rib 46 is formed on the outer wall surface of the chain case 5 to connect the boss portion 40*a* of the mount hole 40 and the boss portion 38*a* of a mount hole 38*p* (associated with a bolthole 26*p* of the cylinder head 3) located forward (right in FIG. 6) of the boss portion 40*a*.

The chain case 5 having the above-explained structure can be detachably fixed to the cylinder block 2, cylinder head 3 and crank case 4 forming the main body of the engine 1 by putting the chain case over the lateral surface of the engine body made up of the cylinder block 2, cylinder head 3 and crank case 4 shown in FIG. 3, then inserting the bolt 47 through the mount hole 38 of the chain case 5 and fastening it to the corresponding bolthole 26 of the engine body.

The binding force may be enhanced by interposing a thermosetting silicone-based liquid sealing agent such as FIPG, which will set at room temperatures, between the mating surfaces of the engine body and the chain case 5 and by fastening them with the bolt 47.

Figure 2:
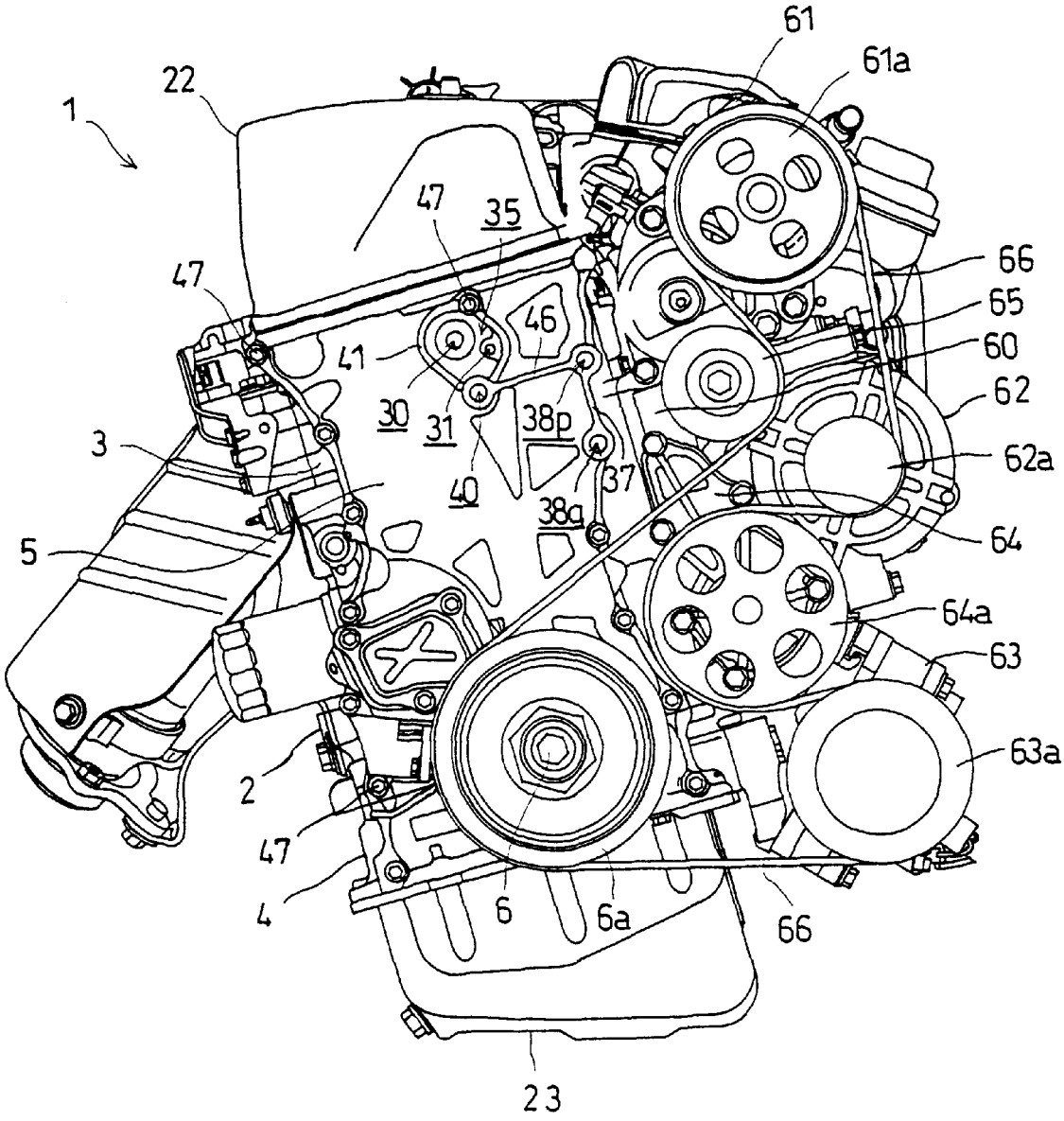
FIG. 2 is a side elevational view of the engine, with some elements being removed from the configuration of FIG. 1.

FIG. 2 shows an aspect in which the chain case 5 has been joined to the main body of the engine 1 and the driving pulley 6*a* has been fit on the crankshaft 6.

Referring to FIGS. 6 and 7, the engine mount bracket 52, already explained, is rigidly fixed with three bolts 48 (FIG. 1) in engagement with the three mount holes 40, 38*p* and the mount hole below and adjacent to the mount hole 38*p* of the chain case 5.

The bolts 48 pass through mount holes of the engine mount bracket 52 and the mount holes 40, 38*p*, 38*q* of the chain case 5, and engage the boltholes 28, 26*p*, 26*q* (the last hole is one of holes of the cylinder block 2 corresponding to the mount hole 38*q*) to fasten the chain case 5 and the engine mount bracket 52 together to the cylinder head 3 and the cylinder block 2.

Figure 4:
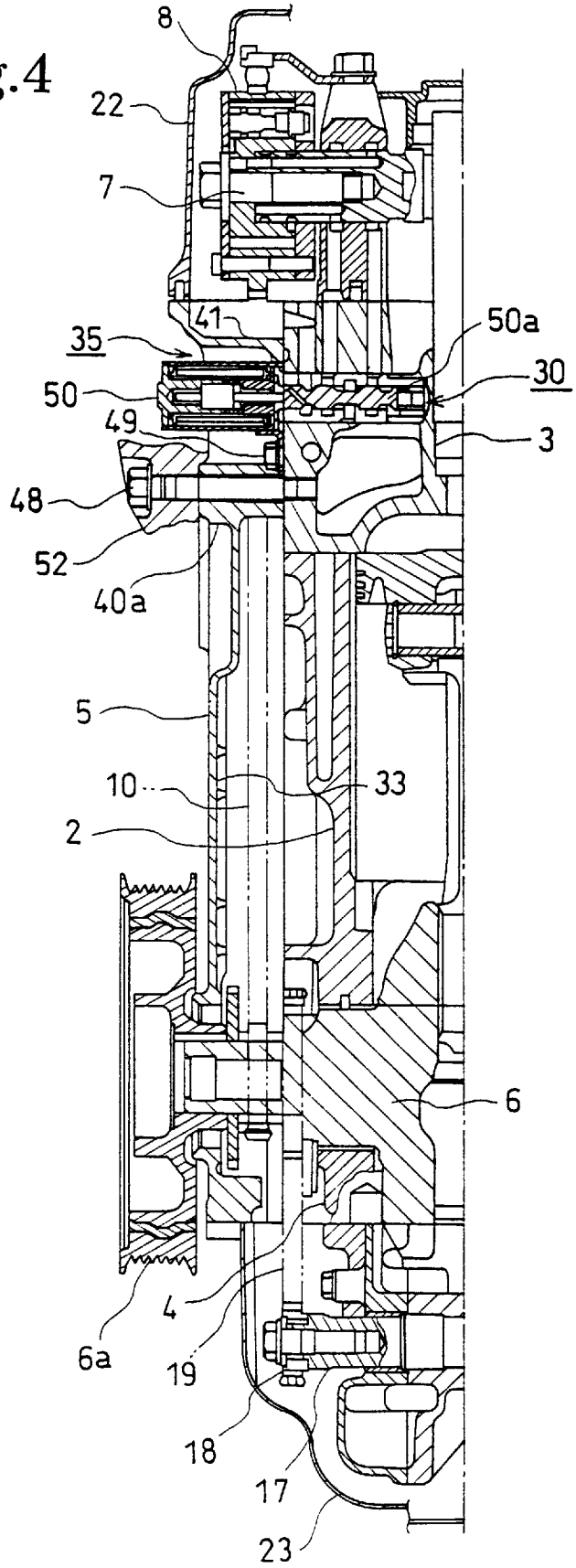
FIG. 4 is a cross-sectional view taken along the IV—IV line of FIG. 1.

As shown in FIGS. 4 and 5, the engaging hole 30 of the cylinder head 3 appears in the opening 35 encircled by the annular connection wall 41 of the chain case 5. A linear valve 50*a* of the variable valve timing solenoid 50 is put in the opening 35 to locate the variable valve timing solenoid 50 in position in the opening 35, and the bolt 49 passing through the bracket projecting toward the variable valve timing solenoid 50 engages the bolthole 31 of the cylinder head 5, thereby to fix the variable valve timing solenoid 50.

FIG. 1 shows an aspect in which the engine mount bracket 52 and the variable valve timing solenoid 50 are held in position. The variable valve timing solenoid 50 can be easily attached and detached for maintenance or replacement through the opening 35 of the chain case 5, without removing the chain case.

As explained above, the chain case 5 is attached by fastening the front and rear edge walls 37 thereof to the main body of the engine 1, and the mounting boss portions 39*a*, 40*a* and the annular connection wall 41 in the central fastening region thereof are brought into abutment with the boss portions 27*a*, 28*a* and the annular projection 29 of the cylinder head 3 and fastened to the cylinder head 3 with the bolts 47, 48.

Therefore, in addition to the advantage that the chain case 5 itself is highly rigid and strong because of the existence of the annular connection wall 41 in its central fastening region, the chain case is significantly enhanced in rigidity by the rigid coupling of the central fastening region of the chain case 5 to the main body of the engine 1 over a wide area defined by the central fastening region of the chain case 5, which results in effective alleviation of vibrations of the central region.

As a result, even upon large vibrations in the cam chain 10 rotated between the engine body composed of the cylinder block 2, cylinder head 3 and crank case 4, and the chain case 5, the chain case 5 is held without large elastic deformation and noise.

Since the connection wall connecting the boss portions 39*a*, 40*a* of the central fastening region of the chain case 5 each other is put in abutment with the main body of the engine 1, the chain case is simplified in shape without the need of a large number of mounting boss portions, which accordingly decreases the number of bolts or other fastening means and makes assembly easier.

Moreover, the region inside the connection wall 41 of the chain case 5 is the opening 35, which reduces the weight of the chain case 5 and the engine 1, and can be used to receive the variable valve timing solenoid 50 mounted to the cylinder head 3 to use the space efficiently.

What is claimed is:

1. A case member mounting structure for mounting a case member to a machinery body, comprising:

outer edge fastening means for fastening an outer edge region of said case member to said machinery body; and center fastening means for fastening a central region of said case member to said machinery body, said center fastening means being located entirely on a side of said central region apart from said outer edge region and including:

a plurality of central mounting portions formed on an inner surface of said case member; and a raised connection wall connecting said central mounting portions, said case member being mounted to said machinery body by bringing said connection wall and said central mounting portions into abutment with said machinery body.

2. A case member mounting structure according to claim 1 wherein said connection wall is annular.

3. A case member mounting structure according to claim 2 further comprising a through hole formed in the region encircled by said annular connection wall to make up means for assembling an other member to said machinery body.

4. A case member mounting structure according to claim 3 wherein said other member is a variable valve timing solenoid.

5. A case member mounting structure according to claim 1 wherein said case member includes inner ribs extending from said center fastening means along the inner surface of said case member.

6. A case member mounting structure according to claim 1 wherein a liquid seal agent is interposed between mating surfaces of said machinery body and said connection wall to be brought into abutment.

7. A case member mounting structure according to claim 1 wherein said case member includes outer ribs extending from said center fastening means along an outer surface of said case member.

8. A case member mounting structure according to claim 1, wherein said outer edge fastening means does not include said central mounting portions.

9. A case member mounting structure according to claim 1, wherein said central region does not overlap with said outer edge region.

10. A case member mounting structure for mounting a chain case to an engine body, comprising:

outer edge fastening means for fastening an outer edge region of said chain case to said engine body; and center fastening means for fastening a central region of said chain case to said engine body, said center fastening means being located entirely on a side of said central region apart from said outer edge region and including:

a plurality of central mounting portions formed on an inner surface of said chain case; and a raised connection wall connecting said central mounting portions, said chain case being mounted to said engine body by bringing said connection wall and said central mounting portions into abutment with said engine body.

11. A case member mounting structure according to claim 10 wherein said connection wall is annular.

12. A case member mounting structure according to claim 11 further comprising a through hole formed in the region encircled by said annular connection wall to make up means for assembling an other member to said engine body.

13. A case member mounting structure according to claim 12 wherein said other member is a variable valve timing solenoid.

14. A case member mounting structure according to claim 10 wherein said chain case includes inner ribs extending from said center fastening means along the inner surface of said chain case.

15. A case member mounting structure according to claim 10 wherein a liquid seal agent is interposed between mating surfaces of said engine body and said connection wall to be brought into abutment.

16. A case member mounting structure according to claim 10 wherein an engine mount bracket is fastened together by said center fastening means.

17. A case member mounting structure according to claim 10 wherein said chain case includes outer ribs extending from said center fastening means along an outer surface of said chain case.

18. A case member mounting structure according to claim 10 wherein an endless driving chain is disposed inside said chain case, and said connection wall is located in a region encircled by said endless driving chain.

19. A case member mounting structure according to claim 4, wherein said outer edge fastening means does not include said central mounting portions.

20. A case member mounting structure according to claim 4, wherein said central region does not overlap with said outer edge region.

* * * * *